United States Patent [19]

Fritsch

[11] Patent Number: 4,873,404

[45] Date of Patent: Oct. 10, 1989

[54] LOW-FRICTION DRIVE LINK FOR AUXILIARY HANDLE OPERATION TO MOLDED CASE CIRCUIT BREAKER CONNECTION

[75] Inventor: Ronald J. Fritsch, Sussex, Wis.

[73] Assignee: Eaton Corporation, Cleveland, Ohio

[21] Appl. No.: 233,102

[22] Filed: Aug. 17, 1988

[51] Int. Cl.[4] ..... H01H 25/00

[52] U.S. Cl. ..... 200/332; 200/335; 200/337; 200/401; 200/50 A; 74/503

[58] Field of Search ..... 200/332, 331, 330, 337, 200/338, 50 A, 401; 74/503; 384/58

[56] References Cited

U.S. PATENT DOCUMENTS

| | | | |
|---|---|---|---|
| 1,989,393 | 1/1935 | Anderson | 200/330 |
| 2,237,530 | 4/1941 | Olley | 200/330 X |
| 2,418,006 | 3/1947 | Bangert, Jr. | 200/330 |
| 3,054,867 | 9/1962 | Rimmer | 200/330 X |
| 3,272,953 | 9/1966 | Tillson | 200/330 |
| 3,369,100 | 2/1968 | Kussy et al. | 200/330 |
| 3,384,722 | 5/1968 | Hanke et al. | 200/50 A |
| 3,939,725 | 2/1976 | Fischer | 74/503 |
| 3,978,304 | 8/1976 | Salvati et al. | 200/331 |
| 4,019,784 | 4/1977 | Ladin et al. | 384/58 |
| 4,760,220 | 7/1988 | Fritsch et al. | 200/50 A |

*Primary Examiner*—Ernest G. Cusick

*Attorney, Agent, or Firm*—L. G. Vande Zande

[57] ABSTRACT

A drive lever of an auxiliary handle operator is pivotally mounted alongside a molded case circuit breaker to move in a plane parallel with a plane of movement of a constituent handle of the circuit breaker. A superstructure attached to the top of the circuit breaker carries a slide disposed over the constituent handle for linear reciprocal movement. The slide has a projection which is disposed in a hollow shaft of a roller bearing structure carried by the drive lever for limited translation perpendicular to slide movement with a limited amount of free play between the corresponding parts.

6 Claims, 2 Drawing Sheets

28
28a
28b
6
7
30
8a
8
10
12a
12
18
8b
8c
24
12b
20
2
2a
2b
26
22
4

2
4
6
7
8
8c
10
12
12a
12b
14
16
18
20
22
24
26
28
28a
28b
30
32
32a
34
36

LOW-FRICTION DRIVE LINK FOR AUXILIARY HANDLE OPERATION TO MOLDED CASE CIRCUIT BREAKER CONNECTION

BACKGROUND OF THE INVENTION

This invention relates to auxiliary operating mechanisms for molded case circuit breakers or the like which are mounted within an enclosure and are operated by an auxiliary handle operator accessible externally of the enclosure. Mechanisms of this type are utilized in individual removable control units of motor control centers such as disclosed in U.S. Pat. No. 4,760,220 entitled "Operator Mechanism Having Reduced Handle Throw and Improved Handle Lock" issued July 26, 1988, assigned to the assignee of this application. The disclosure of U.S. Pat. No. 4,760,220 is incorporated herein by reference In apparatus of the aforementioned type, the molded case circuit breaker has a constituent handle which is pivotally mounted within the molded case. The enclosure has an auxiliary handle operator by which the breaker may be operated from the exterior of the enclosure. The auxiliary handle operator commonly comprises a drive lever which is pivotally mounted within the enclosure along one side of the molded case circuit breaker. The interconnection, or drive link, between the drive lever and the operating handle of the circuit breaker may comprise various embodiments. One such embodiment is disclosed in the aforementioned U.S. Pat. No. 4,760,220 wherein an inverted U-shaped bail member having an opening in the bight thereof for the circuit breaker operating handle is pivotally mounted to straddle the breaker and be disposed over the operating handle. This bail is connected to the drive lever by means of a straight link pivotally connected at its opposite ends to the respective bail and drive lever. Another such embodiment comprises a superstructure affixed to the top surface of the molded case circuit breaker. This superstructure comprises a mounting plate affixed to the breaker housing and supporting a linearly reciprocal slide member which has a fork for receiving the operating handle of the breaker at one end and a tongue projecting laterally to the direction of movement. The same pivotally supported drive lever is used, but in this embodiment the drive lever further comprises a bracket attached thereto which has a closed-end slot disposed therein perpendicularly to the direction of movement of the slide. In previous designs, the leg of the bracket includes a slot into which the tongue of the slide member projects for movement of the slide member back and forth to operate the handle of the circuit breaker in response to movement of the auxiliary handle operator. The relatively sharp edges of the tongue and of the cooperating opening in the bracket leg create a significant amount of friction between the members. Additionally, the amount of clearance necessary between the tongue and the width of the opening in the bracket provides a looseness in the system which renders the exact position of the auxiliary handle indeterminate as to when the circuit breaker operates between on and off positions.

SUMMARY OF THE INVENTION

This invention provides an auxiliary handle operator means for a molded case circuit breaker in which the connection between the auxiliary handle operator and the drive mechanism for the molded case circuit breaker is both a low friction connection and one which has a minimal amount of looseness, thereby to provide positive auxiliary handle operator positioning with respect to positioning of the circuit breaker constituent handle. The invention provides a linearly reciprocal slide member disposed over the constituent handle of the molded case circuit breaker and supported in that position for linear sliding movement by a support plate which is affixed to the front surface of the molded case circuit breaker as a superstructure. A drive lever of the auxiliary handle operator is pivotally supported adjacent the molded case circuit breaker at one side thereof. The drive lever is provided with an opening, either directly in the drive lever, or by a bracket attached thereto having a leg with an opening therein. A roller bearing assembly is disposed over a laterally projecting tongue of the slide member and is fixed within the opening in the drive lever to provide a roller bearing member engaging the edges of the opening with small tolerance accumulations, but rolling therealong to provide a low friction connection. The invention, its features and advantages, will become more apparent in the following description and claims when read in conjunction with the accompanying drawings.

DESCRIPTION OF THE PREFERRED EMBODIMENT

Figure 1:
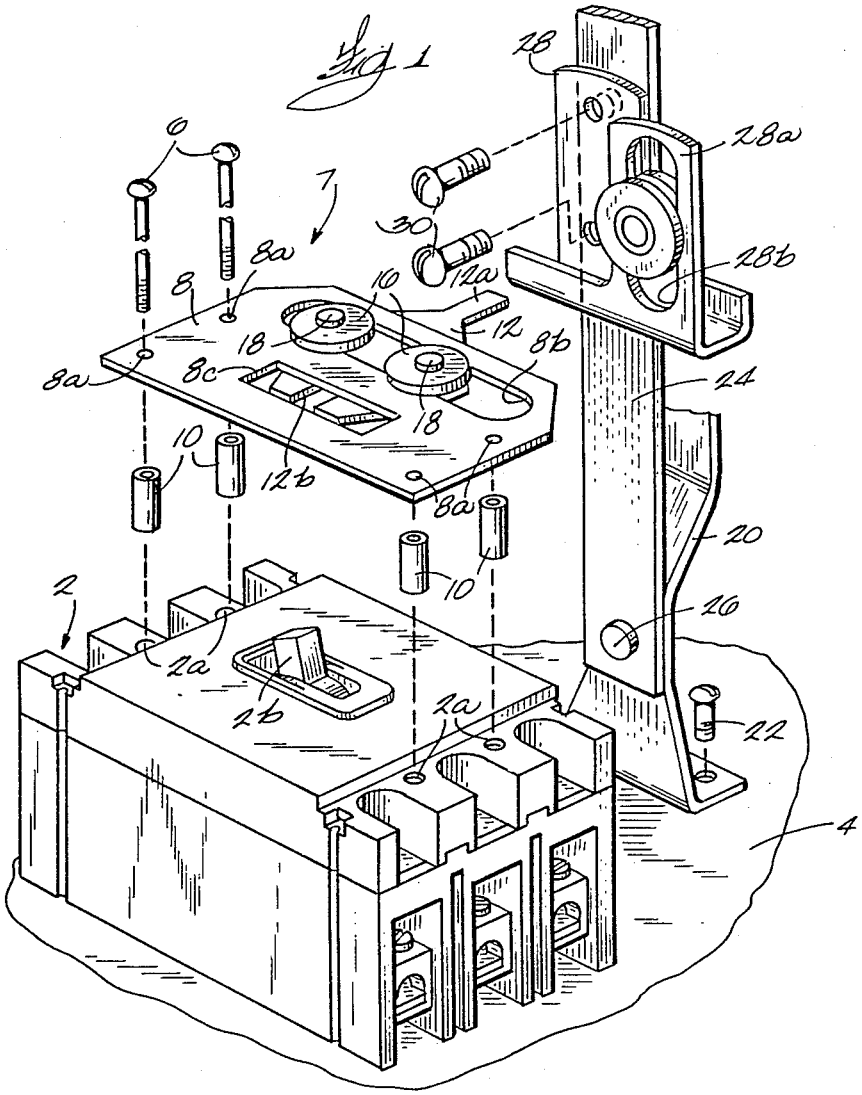
FIG. 1 is an exploded isometric view of a molded case circuit breaker and auxiliary operating mechanism constructed in accordance with this invention.

A molded case circuit breaker 2 is mounted to a panel 4 by four screws 6 (only two of which are shown). Screws 6 also serve to affix a superstructure 7 to the top of the molded case circuit breaker 2. The screws penetrate holes **8*a* in a flat mounting plate 8 and pass through aligned cylindrical spacers 10 to extend through openings 2*a* in the circuit breaker housing and threadably engage within openings in the panel 4 or with threaded fasteners at the rear of panel 4. Mounting plate 8 has a first elongate slot 8*b* formed near its right-hand edge as viewed in FIG. 1 and a second, somewhat shorter slot 8*c* centrally located between the ends of the mounting plate 8 near the left-hand side thereof as viewed in FIG. 1. slide member 12 is affixed to the under side of mounting plate 8 in spaced relation by a pair of rollers 14 (one shown in FIG. 2) which are disposed within the slot 8*b*, and enlarged washers 16 which are attached to slide 12 by rivets 18 which extend through the coaxially arranged rollers 14 and washers 16. The washers 16 are of a diameter larger than the narrow dimension of the slot 8*b* to prevent the slide 12 from being removed from the mounting plate 8. Slide 12 has a tongue 12*a* projecting transversely to the direction of movement of the slide and a slot 12*b* formed at its left-hand end which is visible through the slot 8*c* in mounting plate 8. The slot 12*b* forms a fork on the left-hand end of slide 12 which is disposed over the operating handle 2*b* of the molded case circuit breaker 2 when the mounting plate 8 and slide 12 are affixed to the breaker as a superstructure 7 as aforedescribed. When so attached, linear movement of slide member 12 left and right as viewed in FIG. 1 will drive the operating handle 2*b* of molded case circuit breaker 2** between its extreme left and right operating positions.

The auxiliary handle operator assembly is shown more particularly in the aforementioned U.S. Pat. No. 4,760,220 and reference may be had thereto for a more complete understanding of such a handle assembly mounted on the enclosure and accessible exteriorly thereof. The auxiliary handle operator assembly includes a brace 20 which extends from the assembly to the panel 4 and is secured thereto by a pair of screws 22 (only one of which is shown). A drive lever 24 is pivotally mounted on brace 20 by a rivet 26 and is reciprocally pivotally movable in a plane which is parallel to the plane of movement of circuit breaker handle **2*b* by movement of the externally accessible operator handle. A bracket 28 is affixed to drive lever 24 by a pair of screws 30. Bracket 28 is essentially U-shaped with the legs being linearly offset from each other. The left-hand leg 28*a* of bracket 28 is spaced from drive lever 24 by the distance of the bight of bracket 28. Leg 28*a* has an opening 28*b* formed therein, the opening 28*b* being completely enclosed by the leg 28*a***.

A roller assembly is assembled within the opening 28b. The roller assembly comprises a hollow cylindrical shaft 32 which has a large washer-like flange **32*a* at its right-hand end as viewed in FIG. 2. The left-hand end of shaft 32 is stepped downward to provide a shoulder against which a large washer 34 is affixed by riveting over the projecting end of shaft 32. Washer 34 corresponds in diameter to flange 32*a* and functions as a second flange on shaft 32, axially spaced from flange 32*a*. A roller 36 is rotatably journaled on the shaft 32 between the flange 32*a* and the washer 34. The diameter of roller 36 is closely matched to the narrow dimension of opening 28*b* to allow the roller 36 to roll along the edges of the opening 28*b* while still maintaining a reasonably close fit therebetween. The internal diameter of hollow shaft 32 is chosen to freely receive the tongue 12*a* of slide 12 without introducing significant free play between the members. The flange 32*a* and washer 34 trap the roller assembly on the bracket 28**.

Figure 2:
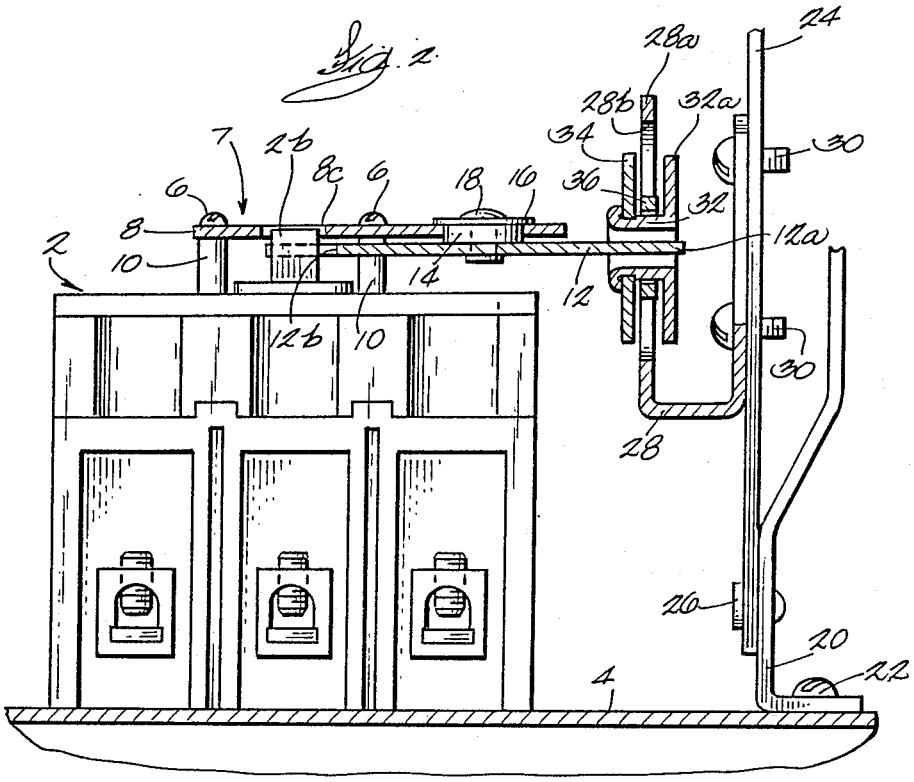
FIG. 2 is a sectional view of the mechanism shown in FIG. 1, taken along a center line of the interconnection between the slide member and the drive lever.

In operation, the drive lever 24 is pivotally moved left or right as viewed in FIG. 1 about the pivot formed by rivet 26 by movement of the auxiliary handle operator. This movement carries the slide member 12 left or right by virtue of the connection between tongue **12*a* and the inside of shaft 32. Vertical translation of bracket 28 when the drive lever 24 is pivoted is permitted by the elongated opening 28*b*. The close fitting correspondence of roller 36 within opening 28*b* and tongue 12*a* within shaft 32 provides a low friction drive for circuit breaker operating handle 2**b and a predetermined position of the auxiliary operator handle when the circuit breaker is operated to one or the other extreme handle positions.

The foregoing has described a preferred embodiment of low-friction drive link between an auxiliary handle operator mechanism and a molded case circuit breaker constituent operating handle. It is contemplated herein that bracket 28 may be omitted and opening **28*b* may be formed directly in drive lever 24** when mounting space is limited. It shall be recognized that the invention is susceptible of various other modifications without departing from the scope of the appended claims.

I claim:

1. A low-friction drive link connecting auxiliary handle operator means to a molded case circuit breaker, said circuit breaker having a constituent operating handle and a superstructure supporting a linearly reciprocally movable slide disposed over said operating handle, said slide having a projection disposed transversly to direction of movement of said slide, said handle operator means having a drive lever pivotally supported at one side of said circuit breaker and movable in a plane parallel to a plane of movement of said circuit breaker operator handle, said drive lever including means defining an elongated opening oriented angularly to said direction of movement of said slide at each possible position of said drive lever, said projection extending within said opening, and roller means disposed over said projection, said roller means having a peripheral surface in rolling engagement with edges of said opening.

2. The low-friction drive link defined in claim 1 wherein said roller means comprises a hollow cylindrical shaft disposed over said projection and a roller rotatably journaled on said shaft.

3. A low-friction drive link defined in claim 2 further comprising means maintaining said roller means positioned within said opening.

4. The low-friction drive link defined in claim 3 wherein said means maintaining said roller means positioned within said opening comprises spaced flanges fixed relative to said shaft, said roller being journaled on said shaft between said flanges, and said flanges being larger than said opening.

5. The low-friction drive link defined in claim 4 wherein said means defining said elongated opening comprises a bracket, fixed to said drive lever, having a leg spaced from said drive lever, and said elongated opening being in said leg.

6. The low-friction drive link defined in claim 5 wherein said elongated opening is defined by said bracket leg as a completely surrounded opening and said roller means is non-removable on said bracket leg.

* * * * *